US009283134B2

(12) United States Patent
Leismer et al.

(10) Patent No.: US 9,283,134 B2
(45) Date of Patent: Mar. 15, 2016

(54) VIBRATION UNIT FOR MUSCULOSKELETAL VIBRATIONS SYSTEM FOR JOINTED LIMBS

(75) Inventors: Jeffery Michael Leismer, Sheboygan, WI (US); Nadder David Sahar, Milwaukee, WI (US)

(73) Assignee: WiSys Technology Foundation, Inc., Madison, WI (US)

( * ) Notice: Subject to any disclaimer, the term of this patent is extended or adjusted under 35 U.S.C. 154(b) by 798 days.

(21) Appl. No.: 13/397,145

(22) Filed: Feb. 15, 2012

(65) Prior Publication Data

US 2012/0209155 A1 Aug. 16, 2012

Related U.S. Application Data

(60) Provisional application No. 61/443,037, filed on Feb. 15, 2011.

(51) Int. Cl.
*A61H 1/00* (2006.01)
*A61H 23/00* (2006.01)
(Continued)

(52) U.S. Cl.
CPC ..... *A61H 1/006* (2013.01); *A61H 1/024* (2013.01); *A61H 23/00* (2013.01); *A61H 23/0254* (2013.01); *A61H 23/0263* (2013.01); *A61H 1/00* (2013.01); *A61H 23/02* (2013.01);
(Continued)

(58) Field of Classification Search
CPC ..... A61H 23/0254; A61H 23/00; A61H 1/02; A61H 1/00; A61H 23/02; A61H 1/006; A61H 1/024; A61H 2201/0192; A61H 2205/102; A61H 2203/0456; A61H 2201/163; A61H 2201/5012; A61H 2201/0437; A61H 2201/5061; A61H 221/5005; A61H 2201/1642; A61H 2201/5097; A61H 2205/10; A61H 2205/088; A61H 2201/149
USPC ..... 601/15, 18, 19, 23, 24, 26, 27, 29, 30, 601/31, 32, 33, 34, 35, 46, 49, 50, 51, 53, 601/54, 60, 65, 67, 69, 70, 72, 82, 84, 86, 601/87, 89, 94, 95, 97, 98, 101, 103, 104, 601/134, 135, 136, 137; 74/86, 87, 89.23, 74/570.1, 571.1, 571.11
See application file for complete search history.

(56) References Cited

U.S. PATENT DOCUMENTS 688,581 A * 12/1901 Bihlmaier ..... 601/97
743,147 A * 11/1903 Church ..... 601/97
(Continued)

FOREIGN PATENT DOCUMENTS

WO WO2006030298 3/2006

OTHER PUBLICATIONS

Harold Merriman et al., The Effects of Whole-Body Vibration Training in Aging Adults: A Systematic Review, Journal of Geriatric Physical Therapy, vol. 32:3:09.
(Continued)

*Primary Examiner* — Justine Yu
*Assistant Examiner* — Tu Vo
(74) *Attorney, Agent, or Firm* — Boyle Fredrickson, S.C.

(57) ABSTRACT

A system includes a vibration unit that provides independent adjustability of vibration characteristics such as frequency and amplitude and may provide a first motor that rotates an eccentric and can adjust vibration frequency and a second motor that that may move the eccentric within the vibration unit in a manner that adjusts amplitude of the vibration.

8 Claims, 7 Drawing Sheets

(51) Int. Cl.
*A61H 23/02* (2006.01)
*A61H 1/02* (2006.01)

(52) U.S. Cl.
CPC . *A61H2201/0192* (2013.01); *A61H 2201/1246* (2013.01); *A61H 2201/149* (2013.01); *A61H 2201/163* (2013.01); *A61H 2201/1642* (2013.01); *A61H 2201/5005* (2013.01); *A61H 2201/5012* (2013.01); *A61H 2201/5061* (2013.01); *A61H 2201/5097* (2013.01); *A61H 2203/0437* (2013.01); *A61H 2203/0456* (2013.01); *A61H 2205/088* (2013.01); *A61H 2205/10* (2013.01); *A61H 2205/102* (2013.01)

(56) References Cited

U.S. PATENT DOCUMENTS

| | | | | |
|---|---|---|---|---|
| 3,911,907 | A * | 10/1975 | Smith, Jr. | 482/1 |
| 4,469,093 | A * | 9/1984 | Chaplar | 601/103 |
| 4,485,693 | A * | 12/1984 | Heikkila | 74/836 |
| 4,862,756 | A * | 9/1989 | Dutschke | 74/26 |
| 6,105,252 | A | 8/2000 | Andis | |
| 6,505,361 | B1 * | 1/2003 | Ogawa | 5/109 |
| 6,620,117 | B1 | 9/2003 | Johnson et al. | |
| 6,923,773 | B2 | 8/2005 | Leivseth et al. | |
| 7,662,115 | B2 | 2/2010 | Leismer | |
| 2005/0033203 | A1 | 2/2005 | Son | |
| 2006/0217639 | A1 | 9/2006 | Leismer | |
| 2008/0132813 | A1 | 6/2008 | Katsuta | |
| 2008/0167589 | A1 | 7/2008 | Fung | |
| 2009/0086569 | A1 | 4/2009 | Wu et al. | |
| 2010/0222722 | A1 | 9/2010 | Leismer | |
| 2010/0236355 | A1 * | 9/2010 | Ambardekar | 74/571.11 |

OTHER PUBLICATIONS

L. Slatkovska et al., Effect of whole-body vibration on BMD: a systematic review and meta-analysis, published online Apr. 21, 2010, Osteoporos Int, DOI 10.1007/s00198-010-1228-z.

WS. Von Stengel et al., Effect of whole-body vibration on neuromuscular performance and body composition for females 65 years and older: a randomized-controlled trial; Feb. 5, 2010, Scandinavian Journal of Medicine & Science in Sports, doi: 10.1111/j.1600-0838.2010.01126.x.

A. Machado et al., Whole-body vibration training increases muscle strength and mass in older women: a randomized-controlled trial, Dec. 29, 2008, Scandinavian Journal of Medicine & Science in Sports, doi: 10.1111/j.1600-0838.2009.00919.x.

Edwin R. Mulder et al., Influence of vibration resistance training on knee extensor and plantar flexor size, strength, and contractile speed characteristics after 60 days of bed rest, Oct. 1, 2009, Journal of Applied Physiology, 107; 1789-1798, 2009, doi: 10.1152/japplphysiol.00230.2009.

International Search Report for international application No. PCT/US2012/025294, International filing date Feb. 15, 2012.

International Search Report for Internationsl application No. PCT/US2012/025296 , International filed is Feb. 15, 2012.

* cited by examiner

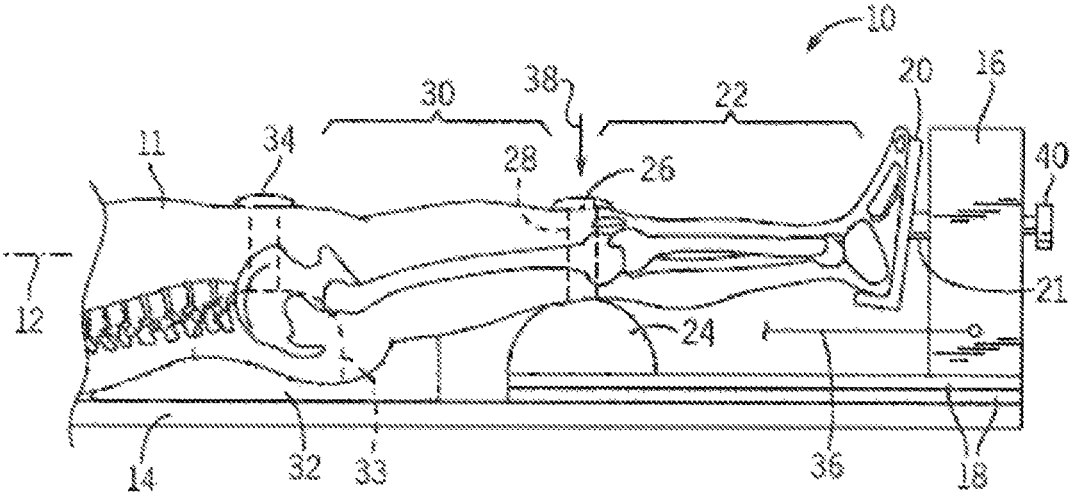
FIG. 1
FIG. 2
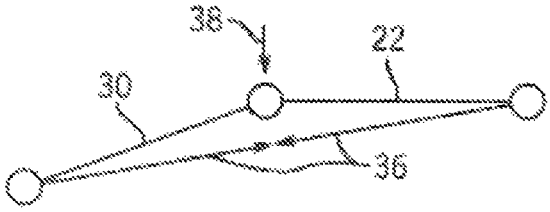
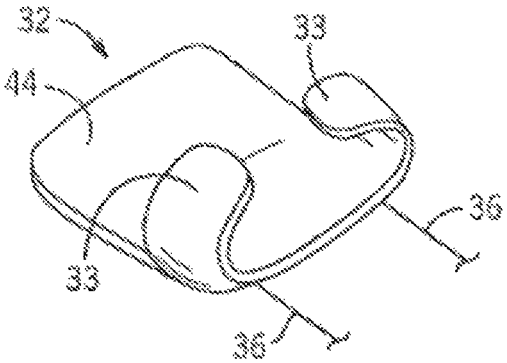
FIG. 3
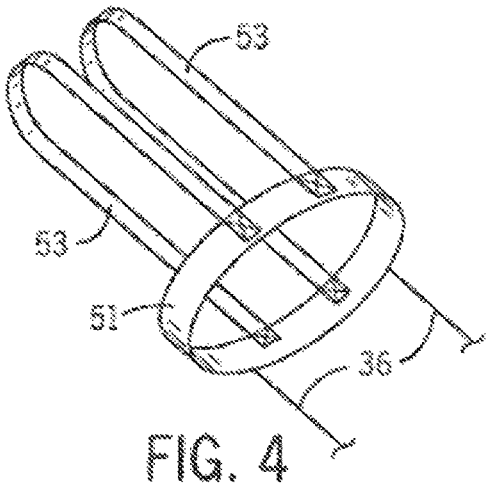
FIG. 4

VIBRATION UNIT FOR MUSCULOSKELETAL VIBRATIONS SYSTEM FOR JOINTED LIMBS

CROSS REFERENCE TO RELATED APPLICATION

The present application claims the benefit of U.S. Provisional Patent Application Ser. No. 61/443,037 filed on Feb. 15, 2011.

BACKGROUND OF THE INVENTION

The present invention relates to a musculoskeletal loading system for stimulating bone and muscle tissue.

Musculoskeletal tissues atrophy rapidly during periods of disuse, for example, during hospital stays or periods of prolonged bed rest. U.S. Pat. No. 7,662,115, and U.S. patent application 2010/0222722 describe devices for mechanically stimulating bone or muscle and suitable for use with bedridden patients, specifically those who cannot stand on a vibrating platform of the type conventionally used for such stimulation. These patents describe a harness system that pulls a vibrating platform against the sole of the foot as braced by restraining couplings attached at the knees and, optionally, also at the hips. This latter embodiment permits beneficial therapy to be applied to different segments of the jointed limb.

SUMMARY OF THE INVENTION

The present invention includes a vibration unit that may be used for stimulating bone and muscle tissue and that may provide independent adjustability of vibration characteristics such as frequency and amplitude. The vibration unit may provide a first motor that rotates an eccentric and can adjust vibration frequency and a second motor that that may move the eccentric within the vibration unit in a manner that adjusts amplitude of the vibration.

It is thus an object of the invention to allow for delivery of highly adjustable vibration stimulus for treating patients.

Specifically then, the present invention provides a system having a vibration unit that may include a shaft positioned for rotation about an axis and having an eccentric portion arranged for rotation along an eccentric path about the axis. A motor may rotate the shaft so that varying the rotational speed of the motor may varying a frequency of a vibration produced by the vibration unit. A follower may be provided that is movable with respect to the axis to move the eccentric portion to different locations within the apparatus. A coupler may be reciprocally driven by the eccentric portion to produce a vibration having an amplitude that corresponds to the position(s) of the follower within the apparatus to allow variability of the amplitude.

Thus, it is an object of the invention to provide a vibration unit that may produce a vibration having independently adjustable frequency and amplitude.

In a further embodiment, an eccentric may include an angled shaft and a bearing that is mounted upon the shaft and that can move axially along the angled shaft to adjust how near the bearing is to an axis of rotation of the eccentric. This may allow the bearing to be moved axially along the angled shaft so as to adjust an amplitude of a vibration being produced by the vibration unit.

It is thus an object of the invention to provide a system that may allow for mechanical adjustment of vibration amplitude.

In a further embodiment, an eccentric wheel may be mounted off center upon an output shaft of a motor. The eccentric wheel may engage and directly drive a patient support into vibrating reciprocation or may engage an intervening pivot arm that drives a patient support into vibrating reciprocation. Moving the engagement location of the eccentric wheel and patient support or pivot arm may provide variation in the amplitude of vibration.

It is thus an object of the invention to provide a system having a vibration unit that allows for controlling amplitude of vibration independently of frequency of vibration with relatively few components can be made with simple machining and assembly procedures.

These particular objects and advantages may apply to only some embodiments falling within the claims and thus do not define the scope of the invention.

BRIEF DESCRIPTION OF THE DRAWINGS

FIG. 1 is a fragmentary, side elevation of view in phantom of a patient positioned on one embodiment of a system of the invention for musculoskeletal stimulation of the leg;

FIG. 2 is a simplified linkage diagram representing the leg of FIG. 1 and showing forces applied by a tension strap and a knee restraint;

FIG. 3 is a perspective view of the first embodiment of a hip support suitable for use with the apparatus of FIG. 1 for applying loading between the patient's feet and hip;

FIG. 4 is a figure similar to that of FIG. 3 showing an alternative to the hip support of FIG. 3 for applying loading between patient's feet and hip and shoulders;

DETAILED DESCRIPTION OF THE PREFERRED EMBODIMENT

Patient Support

Figure 5:
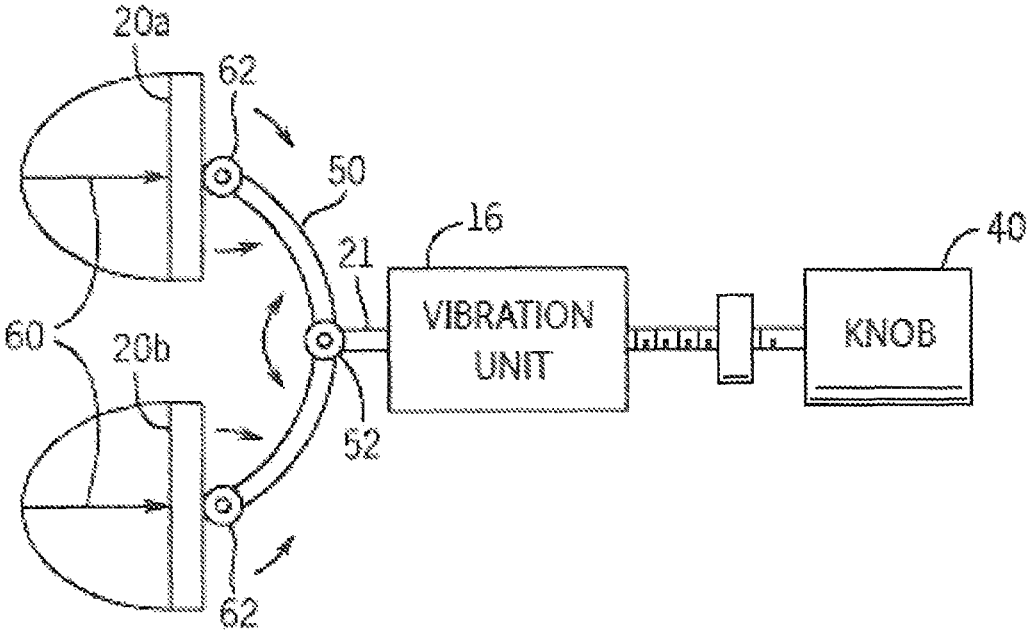
FIG. 5 is a simplified top plan view of a mechanism providing force-equalizing support for foot platforms used in the embodiment of FIG. 1.

Referring now to FIG. 1, in one embodiment, a system 10 provides vibration through the legs of a supine patient 11 lying on a horizontal planar surface of a table 14 such as an examination table or the like. The vibration passes along superior-inferior axis 12 from the patient's foot to the patient's hip.

The vibration is supplied by a vibrator apparatus shown as a vibration unit 16 positioned at one end of the table 14 supported on a linear track 18, the linear track 18 allowing the vibration unit 16 to be moved along axis 12 to different locations to accommodate different patients. A front surface of the vibration unit 16 facing the patient 11 supports foot support 20 for receiving the patient's feet at a height slightly elevated above the table 14 so that a lower leg 22 of the patient is essentially horizontal. The foot support 20 may be a coupler that provides a first support or attachment point between the patient 11, such as a proximal end of a limb to receive vibration, and the system 10. The foot support 20 may be adapted to conduct vibrations from the vibration unit 16 to the patient 11. The foot support 20 may have vertical portions abutting the soles of the patient's feet and attached to a vibrating arm 21 of the vibration unit 16. In this way, the vibration unit 16 may provide vibrations that are transmitted in a vibration transmission direction that may face a direction extending away from the vertical portions of the foot support 20 and generally parallel to a longitudinal axis of the vibrating arm 21 and/or the superior-inferior axis 12. The foot support 20 may further include a horizontal shelf extending from a lower edge of the vertical portions providing a support for the patient's heel from below.

A joint restraint may limit out-of-axis movement of a joint that is provided between the proximal and distal ends of the patient's limb being treated. In one embodiment, the patient's knee may be restrained against movement along the direction perpendicular to the axis 12 by a padded support cushion 24 beneath the knee (as held on the linear track 18) and an upper padded restraint 26 communicating by straps 28 to the linear track 18. Accordingly, the knee may be restrained in a manner that prevents hip flexion or hip extension so that an end of the upper leg 30 that connects to the knee is maintained at a constant height or position. This restraint allows some axial motion but largely prevents upward or downward motion of the knee. In this regard, the padded restraint 26 may locate the knee in an axial alignment position in which an axis of rotation of the knee, about which the knee flexes and extends, faces a first direction and the restraint 26 may limit movements of the knee outside of this axial alignment position and thus upwardly or downwardly away from the vibration transmission direction. The padded restraint 26 may be provided to the knee so as to allow natural compressive interaction between the bones of the lower leg 22 and of the upper leg 30. It will be appreciated that in an alternative embodiment, the padded support cushion 24 may be attached directly to the table 14.

Still referring to FIG. 1, the patient's hips may be supported on a back support 32 that may provide a second support or attachment point between the patient 11, such as a distal end of a limb to receive vibration, and the system 10. The back support 32 may be attached directly to the table 14 and adjustment of the linear track 18 may be used move the vibration unit 16 and accommodate patients with different leg length. The patient's hips may be restrained by the back support 32 with respect to the table 14 simply by friction and the weight of the patient or by an auxiliary padded belt 34 pulling the patient 11 against the back support 32. The back support 32 may include wings 33 extending upward about the hips further restraining motion of the patient's hips.

Referring also to FIG. 2, generally, the location of the hips will be slightly below that of the knee so that the bones of the upper leg 30 and lower leg 22 are slightly angled.

Referring again to FIG. 1, a tension member 36, for example, a cable or strap, may attach at one end to the vibration unit 16 (or any point on the movable surface of the linear track 18) and at the other end to a point fixed with respect to the patient's hips, for example, the wings 33 of the back support 32 (if they are sufficiently stiff) or the table 14. The tension member 36 may be used to provide a predetermined compression preload to the patient's legs by biasing and thus moving the vibration unit 16 toward the back support 32, the supports that engage opposing ends of the leg and generally face toward each other, so as to reduce the distance therebetween and define a direction of compression along which the vibration unit 16 may move. Notably, this preload or compression passes through the joint of the knee and is not simply across the bones of the upper leg 30 and lower leg 22. The amount(s) of compression or preload which may be stored in the memory of a controller 80 (FIGS. 8 and 10) or which may be set using a console 82 (FIGS. 8 and 10) is described in greater detail elsewhere herein.

By slight angulation of the patient's leg, as shown in FIG. 2, tension on the tension member 36 is translated to a compression on the leg, with flexure of the leg (such as would lessen the vibration to the upper leg) prevented by out-of-axis restraint of the knee indicated by force arrow 38. The preload compression may be achieved by the tension member 36 biasing and thus moving the complete vibration unit 16 toward the back support 32.

This force can be provided without the need for a tight restraint on the knee, for example, without using collars on the knee of the type that would support individual tension members between the knee and foot and between the knee and hip. It will be understood that this support of the joint permits vibration imparted to the foot of the patient to be transferred through lower leg 22 and the intervening knee joint to the upper leg 30.

The tension member 36 may include a spring scale, load cell, or other measuring device to provide an indication of the tension and thus to permit a predetermined preloading of compression on the patient's leg with the vibration unit 16 freely movable with low friction on the linear track 18. An adjustment mechanism, such as a lead screw, for shortening or lengthening the tension member 36 may be used for this purpose. Alternatively, the linear track 18 may be locked against movement, and the compression on the leg may be adjusted by changing the relative position between the foot support 20 and the vibration unit 16 using, for example, a knob 40 attached to a lead screw or the like joining the vibration unit 16 and the foot support 20.

The vibration unit 16 may provide for predetermined amplitude of vibration in a range of frequencies, for example, as taught by U.S. Pat. No. 7,662,115. Alternatively, a vibration unit 16 providing controlled amplitude may also be used as will be described below.

Referring now to FIG. 3, the back support 32 may provide a semi-rigid molded contoured back 44 having an upper padded surface and fitting beneath the patient's hips and padded wing 33 curving up and around the patient's abdomen. The tension members 36 may be attached to the rigid portion of the back 44 or to the wings.

Alternatively, as shown in FIG. 4, in yet another embodiment, a belt 51 fitting around the patient's hips and/or suspenders 53 fitting over the patient's shoulders may be used to provide a termination point for the tension members 36 transmitting this force to the patient's hips and shoulders and permitting, in the latter case, vibration to pass into the compressively preloaded patient's lumbar spine. A variety of different restraints are contemplated according to the attached materials.

Referring now to FIG. 5, the foot support may include a pair of foot platforms 20*a*, 20*b* and the vibration unit 16 may attach to the foot platforms 20*a* and 20*b* for the patient's left and right foot respectively as positioned at either end of a horizontally extending lever 50. The lever 50 is attached at fulcrum point 52 to the vibrating arm 21 of the vibration unit 16 providing the desired vibration. The fulcrum point 52 allows equalization of forces 60 from the vibration unit 16 to the feet by pivoting in the manner of the balance. Each of the foot platforms 20*a* and 20*b* may likewise be attached to ends of the lever 50 by pivot points 62 to provide equalization of forces across the foot despite angulation of the ankle.

Figure 6A:
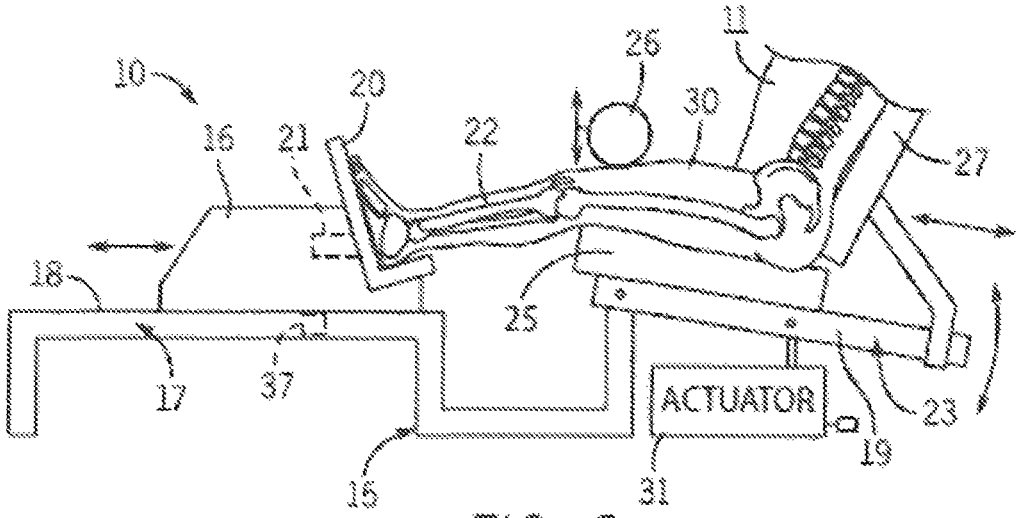
FIG. 6*a* is a fragmentary, side elevation of view in phantom of a patient positioned on another embodiment of a system the invention for musculoskeletal stimulation of the leg.

Referring now to FIG. 6*a*, in this embodiment, system 10 is largely the same as that of FIG. 1, whereby such description need not be repeated here. One difference between the systems of FIG. 6 and FIG. 1 is that the system 10 of FIG. 6 provides vibration through the legs of a patient 11 who is in a seated position instead of a patient 11 who is lying down as in FIG. 1. System 10 of FIG. 6 includes a frame 15 that has a vibration unit support 17 and a seat support 19. The vibration unit support 17 has interconnected pieces of tubing, including spaced-apart upright pieces of tubing that are connected at their upper ends by horizontally extending pieces of tubing. The horizontally extending pieces of tubing of the vibration unit support 17 provide the linear track 18 allowing the vibration unit 16 to be moved longitudinally with respect to the frame 15 to accommodate different patients and to facilitate compression preload to the patient's legs.

Still referring to FIG. 6*a*, the vibration unit 16 may be placed into longitudinal movement along the frame 15 by a tension element that provides a linear actuator-type position drive 37 that can include an electric motor that rotates a gear which engages a fixed toothed rack (not shown) or rotates a nut upon a lead screw (not shown) or the like to create the movement of the vibration unit 16. Like the previously discussed tension member 36, the position drive 37 may include or cooperate with a spring scale, load cell, or other measuring device to provide an indication of the tension and thus to permit a predetermined preloading of compression on the patient's leg(s) with the vibration unit 16 freely movable with low friction on the linear track 18. The position drive 37 may be operably connected to the control unit 80 and console 82 (FIGS. 8 and 10) for establishing the amount of compression preload for legs of a particular patient.

Still referring to FIG. 6*a*, the seat support 19 includes a forward provided upright piece(s) of tubing to which a front portion of a seat assembly 23 is pivotally coupled in a manner that allows a rear portion of the seat assembly 23 to move up and down. The seat assembly 23 includes a lower seat surface 25 that may be substantially aligned with and thus provided at about the same height as the foot support 20, which may allow the feet and hips of the seated patent 11 to be substantially aligned at the same height. The lower seat surface 25 supports the seated patient 11 from below and a back rest 27 that supports a back of the patient 11 from behind. The back rest 27 may be movable in a longitudinal direction with respect to the lower seat surface 25 to accommodate different sized patients 11. In this embodiment, the padded restraint 26 is aligned with a front portion of the lower seat surface 25 and is height adjustable to accommodate patients 11 having upper legs 30 of different thicknesses while providing an upper boundary to restrict out-of-axis movement of the knee(s) of the patient 11. Such height adjustability of the padded restraint 26 may be provided by a pin that may insert through one of multiple vertically spaced holes in a post to which the padded restrain 26 is mounted and a hole in a collar that is mounted to the upright tubing piece at the front of the seat support 19 and in which the padded restraint post is slidingly held. Optionally, a pair of collars that can receive the padded restraint post may be provided at opposing sides of the seat support 19 so that the padded restraint 26 may be reversibly mounted to either side of the seat support 19 and the patient may enter the seat assembly through a gap that is defined between the padded restraint 26 and lower seat surface 25 at the other side of the seat support 19.

Still referring to FIG. 6*a*, a manual or automated actuator, shown as an actuator 31, supports a back portion of the seat support 19 that is opposite the front pivot attachment. The actuator 31 may include a linear actuator such as a hydraulic or pneumatic cylinder, electrically actuated lead screw, or the like. The actuator 31 may be actuated to a fully extended position that presents the lower seat surface 25 generally parallel to the ground which may facilitate the patient 11 entering the seat assembly 23 for treatment in the system 10. The actuator 31 may be actuated to a fully retracted position that presents the lower seat surface 25 in an angled position in which the back portion is relatively closer to the ground than the front hinged portion. Moving the actuator 31 between the extended and retracted positions during use of the vibration unit 16 allows passive motion to be imparted to the knee joint and thus relative movements between the lower and upper legs 22, 30 without requiring effort of the patient 11. This may provide an arcuate movement path of a rearward portion of the seat assembly 23 so as to flex and extend the knee of the patient 11 while the distance between a forward portion of the seat assembly 23 and the restraint 26 remains substantially constant, so that the knee remains restricted against upward or downward motion along a vertical axis. The actuator 31 may communicate with and be controlled by the controller 80 so as to establish a pattern of cyclical passive motion to the patient 11 during use of the system 10.

Figure 6B:
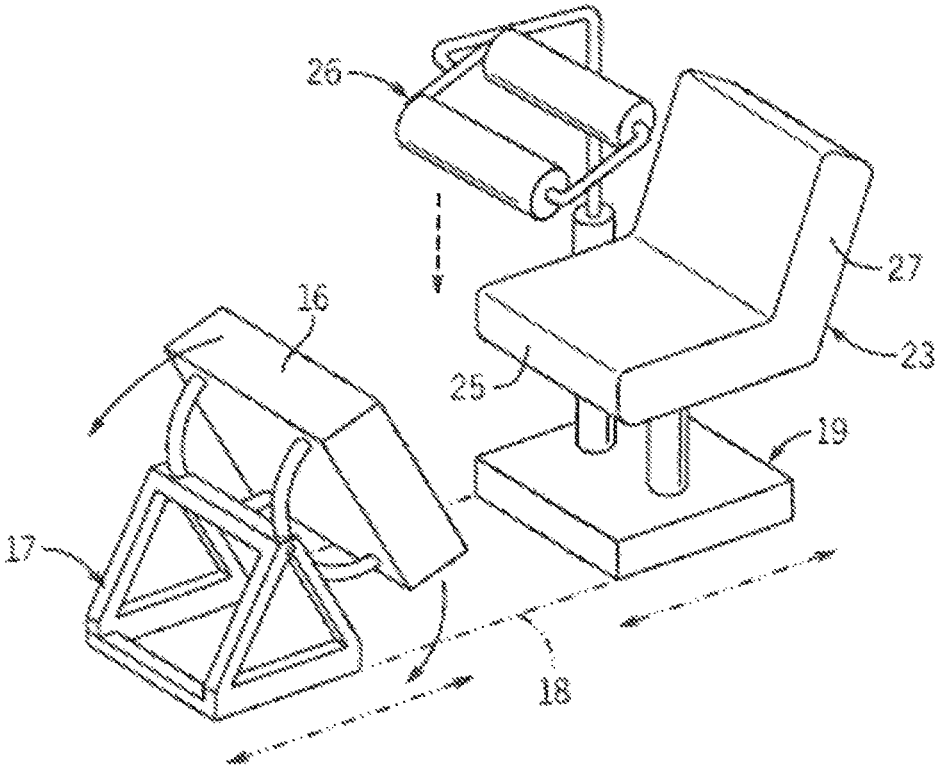
FIG. 6*b* is a variant of the system of FIG. 6*a;*

FIG. 6*b* shows a variant of the system 10 of FIG. 6*a*. In this embodiment, the vibration support 17 and/or the seat support 19 are moveable toward each other. This may be provided by arranging the track 18 longitudinally between the vibration support 17 and the seat support and mounting one or both of the vibration support 17 and/or the seat support 19 to the movable portions of the track 18. Like that described with respect to FIG. 6*a*, the system 10 of FIG. 6*b* may include a tension element that provides a linear actuator-type position drive that may be controlled by the control unit 80 and which may create the linear motion of the vibration support 17 and/or seat support 19. Such tension element may include or cooperate with a spring scale, load cell, or other measuring device to provide an indication of the tension and thus to permit a predetermined preloading of compression on the patient's leg(s) with the vibration unit 16 so as to establish the amount of compression preload for legs of a particular patient. The padded restraint 26 of this embodiment has two segments that are spaced from each other and may be arranged to engage above and below a user's knee(s). The vibration support 17 may provide a hinge or other pivot joint to support the vibration unit 16 while allowing the vibration unit 16 to pivot about a horizontally extending axis. This may allow for manual flexing and extending of a user's ankle joints by an attendant of the system 10 or an actuator (not shown) may be provided within the vibration unit 16 and controlled by the control unit 80 so as to provide oscillating pivotal movements of the vibration unit. Such actuator may be provided external of the vibration unit 16 for providing its pivotal movements, similar to the actuator 31 shown in FIG. 6*a*, only engaging and pushing into oscillation the vibration unit 16 in lieu of or in addition to the seat assembly 23 for embodiments having multiple actuators 31.

Figure 7:
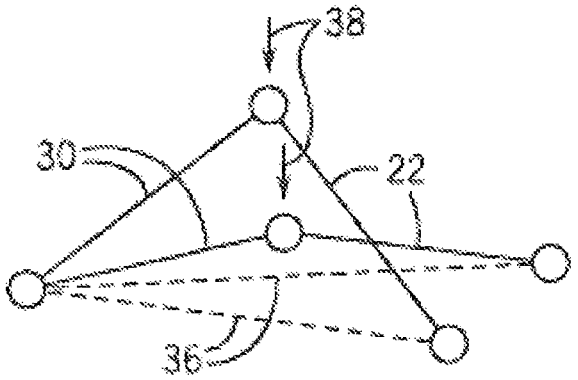
FIG. 7 is a figure similar to that of FIG. 2 showing operation of the present invention for applying vibration under tension during passive or exertive motion.

Referring now to FIG. 7, the ability to impart vibration along the entire length of the jointed limb of a patient with only out-of-axis restraint of the joint permits the present invention to be used to apply vibration to a limb during exercise or movement of the limb, for example, in a passive motion machine of a type known in the art, optionally, by controlling the actuator 31 to impart movement of the seat support 19 as shown in FIG. 6. In such a system, the length of the tension member 36 (FIG. 1) or position drive 37 (FIG. 6) may be optionally adjusted by the controller 80 with motion of the limb to ensure a predetermined preload on the limb as the limb is moved.

Vibration Unit

Figure 8:
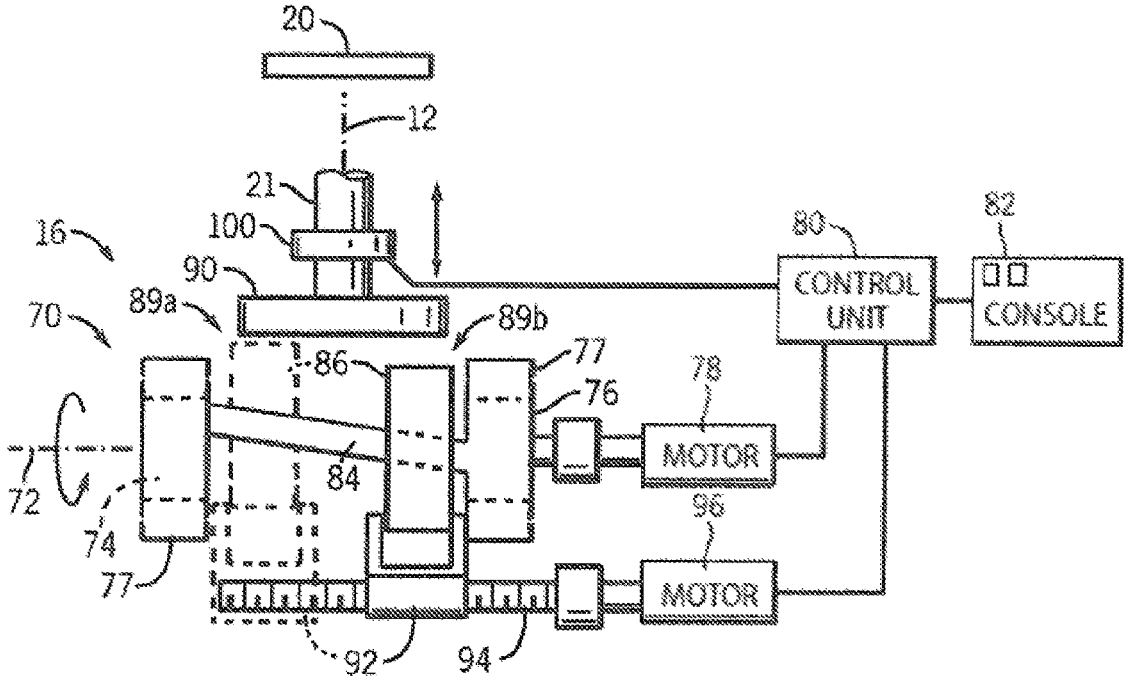
FIG. 8 is a simplified diagram of one embodiment of a vibration mechanism suitable for providing vibration to the foot support of FIG. 1 providing an adjustable eccentric mechanism.
Figure 10:
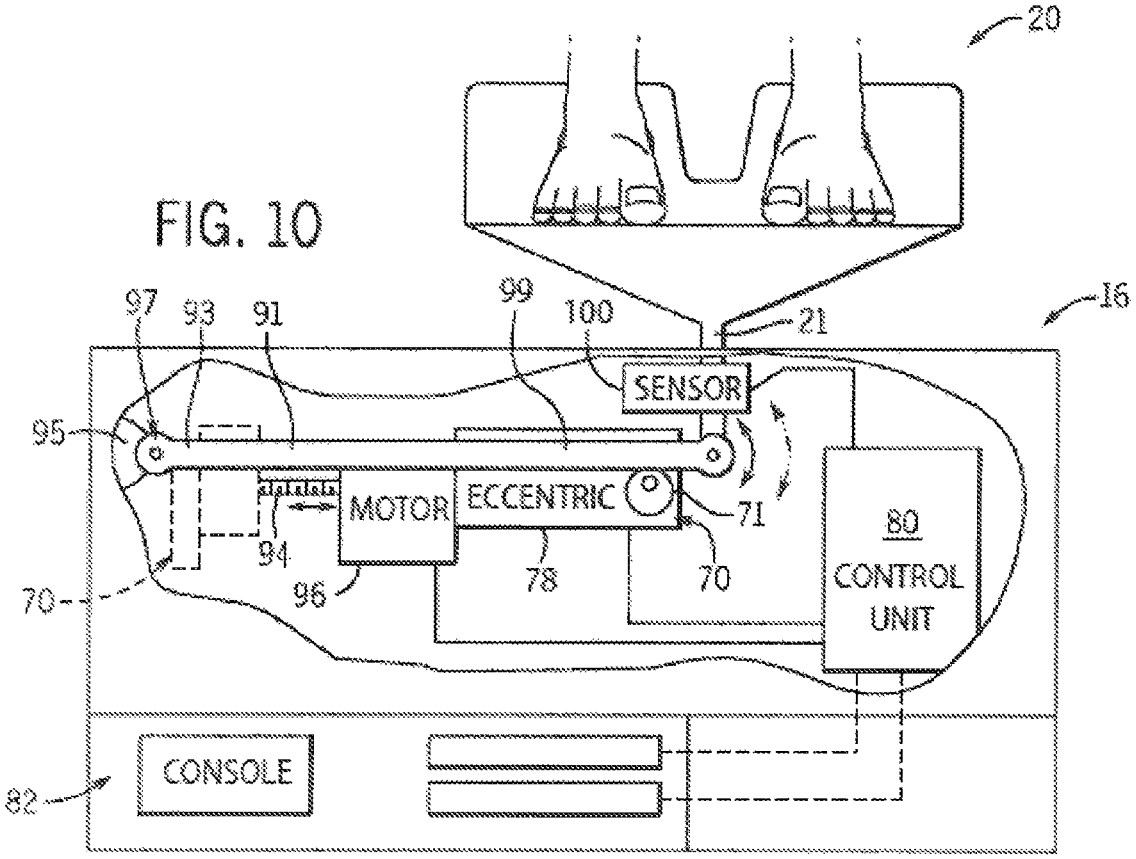
FIG. 10 is a simplified diagram of another embodiment of a vibration mechanism suitable for providing vibration to the foot support of FIG. 1.
Figure 11:
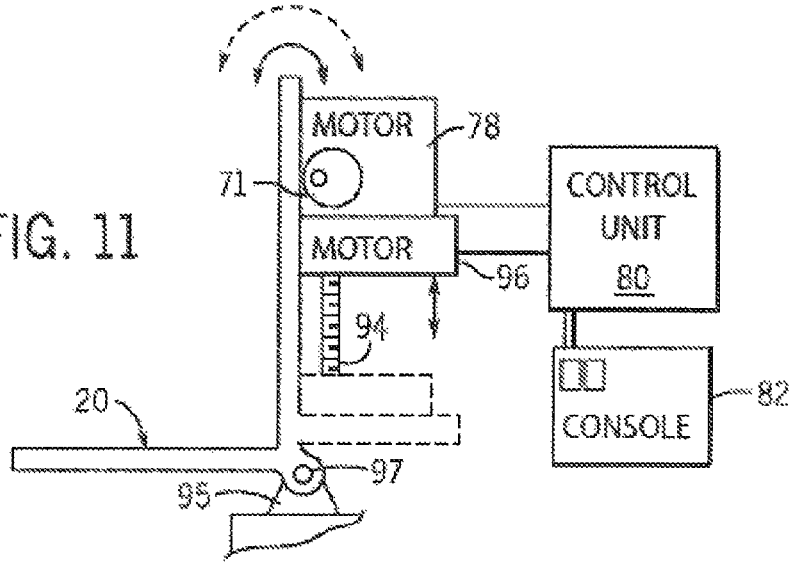
FIG. 11 is a simplified diagram of yet another embodiment of a vibration mechanism suitable for providing vibration to the foot support of FIG. 1.

Referring now to FIGS. 8, 10, and 11, in one embodiment, a vibration unit 16 suitable for use with the present invention may provide both of independently controllable frequency of vibration and controllable amplitude of vibration and thus variable and controlled displacement of the foot support 20. It will be appreciated that control may be alternatively expressed as independently controllable frequency and force, independently controllable force and amplitude, independently controlled frequency and displacement, independently controlled frequency and acceleration, or the like, each being simple mathematical transformations of the others.

Referring now to FIG. 8, in one embodiment, the vibration unit 16 may provide for an eccentric 70 rotating about an axis 72, generally perpendicular to axis 12, along which vibration will be transmitted. The eccentric shaft 70 may have two cylindrical bearing surfaces 74 and 76 aligned along axis 72 and supported by axially aligned bearings 77 for rotation by a first motor 78. The motor 78 may have speed control provided by a control unit 80 (FIGS. 8 and 10), of the type known in the art. The bearing surface 76 may include a stub shaft that extends toward the motor 78 and which may include splines that engage a correspondingly splined coupler at an end of the output shaft of the motor 78.

Still referring to FIG. 8, the control unit 80 (FIGS. 8 and 10) may include one or more processors and one or more memory mediums that have program instructions that are executable by the one or more processors for monitoring operational characteristics of and correspondingly controlling the various components of the system 10 to provide the operations described herein. For example, the control unit 80 may monitor and control the tension member 36 and/or the position drive 37 to provide the preloading force to the tissues of the patient 11 being treated, monitor and control the motor 78 to establish or vary a frequency of vibration and, as described in greater detail elsewhere herein, monitor and control the motor 96 to establish or vary an amplitude of vibration. The control unit 80 may be operably connected to a user console 82 that includes a user interface such as a display and buttons inputting and setting the operational parameters of the system 10 so as to allow manipulation of the preloading, frequency and amplitude of vibration, joint angle within a series of body tissues of the patient being treated, and passive movement characteristics of the joint(s) within a series of body tissues of the patient being treated, as will be described.

Still referring to FIG. 8, the bearing surfaces 74 and 76 as so arranged are joined by a diagonal shaft 84 passing from an inner face of one of the bearing surfaces 74 near its periphery to the opposed inner face of the second of the bearing surfaces 76, at a point near but offset from its axial center. This diagonal shaft 84 may have a generally circular cross-section to be received within an angled bore of a bearing 86 which may be a ball bearing, a plane bearing, or other structure having a bearing surface, that may define an eccentric portion of the eccentric 70 and which is shown in the first position 89*a* and the second position 89*b*. The diagonal shaft 84 and bearing 86 may be provided with corresponding engagement structures such a splines, keys and keyways, optionally non-circular cross sections, which lock the bearing 86 into rotational unison with the diagonal shaft 84 while permitting the bearing to move in a longitudinal direction along the shaft between the position 89*a* and 89*b*. At either position 89*a* or 89*b* representing the extremes of motion of the bearing 86 along the shaft 84, an outer periphery of the bearing 86 may contact a pusher plate 90 communicating with the vibrating arm 21 movable along axis 12 to impart motion to the vibrating arm 21. In this way, as the diagonal shaft 84 rotates, since the bearing 86 is radially spaced from the axis 72, the bearing 86 cyclically advances toward and regresses from the pusher plate 90 to impart a reciprocating motion to the pusher plate 90 as the pusher plate 90 follows the position of the bearing 86 relative to the axis 72.

Still referring to FIG. 8, the bearing 86 is shown in its top-center position in which the pusher plate 90 and vibrating arm 21 are pushed furthest away from the axis 72. When the diagonal shaft 84 is rotated 180 degrees from the position shown in FIG. 8, bearing 86 would be in its bottom-center position in which the pusher plate 90 and vibrating arm 21 would be closest to the axis 72. A position of the bearing 86 axially upon the shaft 84 determines the amplitude of the vibration established by the vibration unit 16.

Figure 9A:
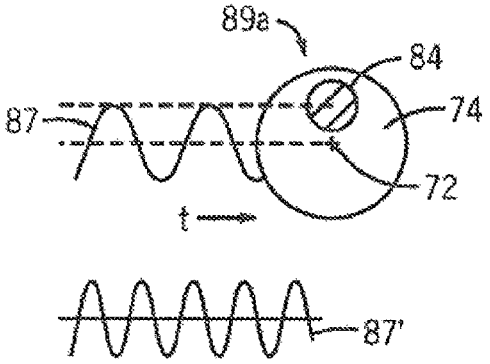
FIGS. 9*a* and 9*b* are diagrams showing two positions of the eccentric mechanism of FIG. 7 for providing different amplitude and frequency of vibration.

Referring now to FIGS. 8 and 9*a*, it will be appreciated that when the bearing 86 is closest to the bearing surface 74 at position 89*a*, it will be supported on a portion of the shaft 84 that is most eccentric with respect to the rotation axis 72 to produce a high amplitude of vibration 87 (shown in FIG. 9*a*) on the pusher plate 90 and hence the vibrating arm 21.

Figure 9B:
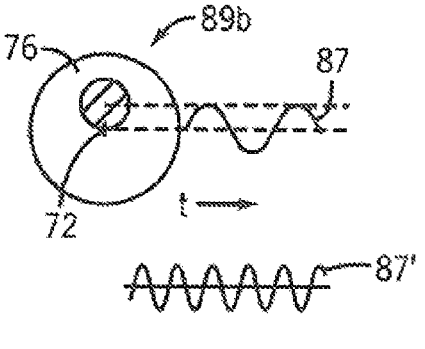

Referring now to FIGS. 8 and 9*b*, when the bearing 86 is at position 89*b* closest to the bearing surface 76, the bearing 86 will be supported on a portion of the shaft 84 that is least eccentric with respect to the rotation axis 72 to produce a low amplitude of vibration 87 (shown in FIG. 9*b*). Accordingly, by movement of the bearing 86 along axis 72 different amplitudes of vibration of the same frequency (independently determined by the rotational speed of the motor 78) may be obtained. This repositioning of bearing 86 may be provided by a positioner that is movable within the vibration unit 16 such as a fork 92 that has tines flanking opposite sides or end surfaces of a periphery of the bearing 86. The fork 92 may move the bearing 86 to align with different portions of a lower surface of the pusher plate 90 by using a linear actuator which may include a lead screw 94 to translate the fork 92 by a second motor 96, also controllable by the control unit 80.

Control of the motor 96 may thus be used to adjust the position of the bearing 86 upon the shaft 84 and thus the amplitude of the vibration independent of its frequency and control of the motor 78 may be used to adjust the frequency of vibration independent of its amplitude. Control of motor 96 may thus also be used to adjust the position of the bearing 86 independent of the amount of preload force being applied by the tension member 36 (FIG. 1) or position drive 37 (FIG. 6).

Still referring to FIG. 8, the vibrating arm 21 may have an attached sensor 100 that is operably coupled to the control unit 80 and which may be, for example, a strain gauge detecting force on the vibrating arm 21 or an accelerometer or the like so as to provide for feedback control of amplitude or velocity according to a control variable of force acceleration or the like by way of the control unit 80. The sensor 100 may be used by the control unit 80 to determine the value of the preload being applied to the patient 11 instead of a separate spring scale, load cell, or other measuring device at the tension member 36 (FIG. 1) and/or the position drive 37 (FIG. 6).

Referring now to FIG. 10, in a second embodiment the vibration unit 16 of this embodiment may also use the control unit 80 to control the motor 78 to vary the frequency of vibration and control the motor 96 to vary the amplitude of the vibration independently of each other. In this case, the positioner may be incorporated into or defined by the eccentric 70 itself, for moving the entire eccentric 70 within the vibration unit 16. In this embodiment, the motors 78 and 96 that may be joined to move together. Movement of both motors 78 and 96 and thus the entire eccentric 70 within the vibration unit 16 may allow for varying the amplitude of vibration, explained in greater detail below.

Still referring to FIG. 10, the eccentric 70 may include an eccentric wheel 71 that defines the eccentric portion of the eccentric 70 and that may have a round perimeter shape and mounted off-center upon an output shaft of the motor 78. An outer circumferential surface of the eccentric wheel 71 engages a surface of a pivot arm 91 that faces the eccentric wheel 71. The pivot arm 91 includes an outer end 93 that is pivot mounted to a bracket 95 which is fixed to a housing of the vibration unit 16 to define a hinge joint 97. An opposing inner end 99 of the pivot arm 91 may be provided relatively nearer a centerline of the vibration unit 16 and may pivot about the hinge joint 97 so as to move along an arcuate travel path. As the eccentric wheel 71 rotates as driven by the motor 78, the pivot arm inner end 99 is cyclically displaced outwardly by the eccentric wheel 71 as the portion of the outer circumferential surface of the eccentric wheel 71 that is radially spaced furthest from the axis of rotation of the motor 78 slides across the surface of the pivot arm 91. The pivot arm 91 cyclically returns to its resting state when the portion of the outer circumferential surface of the eccentric wheel 71 that is radially spaced closest to the axis of rotation of the motor 78 slides across the surface of the pivot arm 91. In this way, rotation of the eccentric wheel 71 forces the pivot arm inner end 99 to oscillate in an arcuate back and forth movement. The pivot arm inner end 99 is pivot connected to the end of the vibrating arm 21 so that the arcuate back and forth movement of the pivot arm inner end 99 is translated into a substantially linear reciprocating movement of the foot support 20. In this way, the pivot arm 91 may act as a third class lever having its fulcrum defined at the hinge joint 97, the load being defined by the vibrating arm 21 and foot support 20, and the effort force being applied by the eccentric wheel 71.

Still referring to FIG. 10, moving the entire eccentric 70 and thus the assemblage of the motors 78, 96 longitudinally with respect to the pivot arm 91 allows the placement of the effort force delivered by the eccentric wheel 71 to be varied along the length of the pivot arm 91. This allows for varying the amplitude of vibration and thus displacement of the vibrating arm 21 and foot support 20, independent of frequency of vibration or preloading of the tissues being treated. The eccentric wheel 71 may displace the portion of the pivot arm 91 that it engages by a predetermined distance maximum difference that corresponds to the radial spacing between the axis of rotation of the output shaft of motor 78 and the portion of the outer circumferential surface of the eccentric wheel 71 that is spaced furthest from such axis of rotation.

Still referring to FIG. 10, when the eccentric wheel 71 drives a portion of the pivot arm 91 that is relatively further from the hinge joint 97, such as shown in FIG. 10 by the eccentric 70 drawn in solid lines, the pivot arm inner end 99 and foot support 20 are displaced a relatively smaller distance(s) and, thus, smaller amplitude(s) of vibration are provided as represented by the solid-line arrow immediately to the right of the pivot arm inner end 99. The eccentric 70 drawn in solid lines in FIG. 10 may provide the low amplitude of vibration 87 shown in FIG. 9*b*. When the eccentric wheel 71 drives a portion of the pivot arm 91 that is relatively nearer to the hinge joint 97, such as shown in FIG. 10 by the eccentric 70 drawn in dashed lines, the pivot arm inner end 99 and foot support 20 are displaced a relatively greater distance(s) and thus larger amplitude(s) of vibration are provided as represented by the dashed-line arrow to the right of the solid-line arrow adjacent the pivot arm inner end 99. The eccentric 70 drawn in dashed lines in FIG. 10 may provide the high amplitude of vibration 87 shown in FIG. 9*a*.

Still referring to FIG. 10, varying of the engagement location of the eccentric wheel 71 upon the pivot arm 91 may be achieved by providing a nut that translates in unison with and is driven into rotation by the motor 96. The nut may be held in a common housing with the output shaft of the motor 96 and may be directly driven by the output shaft or by way of an intervening gear-train. Rotating the nut engages the threads upon the lead screw 94 which is fixed against rotation so as to advance or regress the eccentric 70 along the length of the lead screw 94, depending on the direction of rotation of the nut. Optionally, the lead screw 94 translates in unison with and is rotated by the motor 96 and the nut is fixed against rotation so that rotating the lead screw 94 by the motor 96 provides the movement of the eccentric 70 along the length of the pivot arm 91.

Referring now to FIG. 11, the vibration unit 16 is largely the same as that of FIG. 10, whereby such description need not be repeated here. One difference between the vibration units 16 of FIGS. 10 and 11 is that the vibration unit 16 of FIG. 11 does not utilize a pivot arm 91. Instead, the eccentric wheel 71 engages a surface of the foot support 20 itself. The hinge joint 97 is defined by a lobe that extends from a corner of the orthogonally intersecting segments of the foot support 20 which is pivotally attached to the bracket 95 that is fixed to a housing of the vibration unit 16. In this embodiment, the eccentric 70 is shown as driving an upright segment of the foot support 20, although the eccentric 70 may drive the lower generally horizontal segment of the support in a variant of this embodiment. The eccentric 70 drawn in solid lines in FIG. 11 may provide the low amplitude of vibration 87 shown in FIG. 9*b* since it actuates the foot support 20 at a location that is furthest from the pivot axis of foot support 20 defined at the hinge joint 97. The eccentric 70 drawn in dashed lines in FIG. 11 may provide the high amplitude of vibration 87 shown in FIG. 9*a* since it actuates the foot support 20 at a location that is nearest to the pivot axis of foot support 20 defined at the hinge joint 97.

Figure 12:
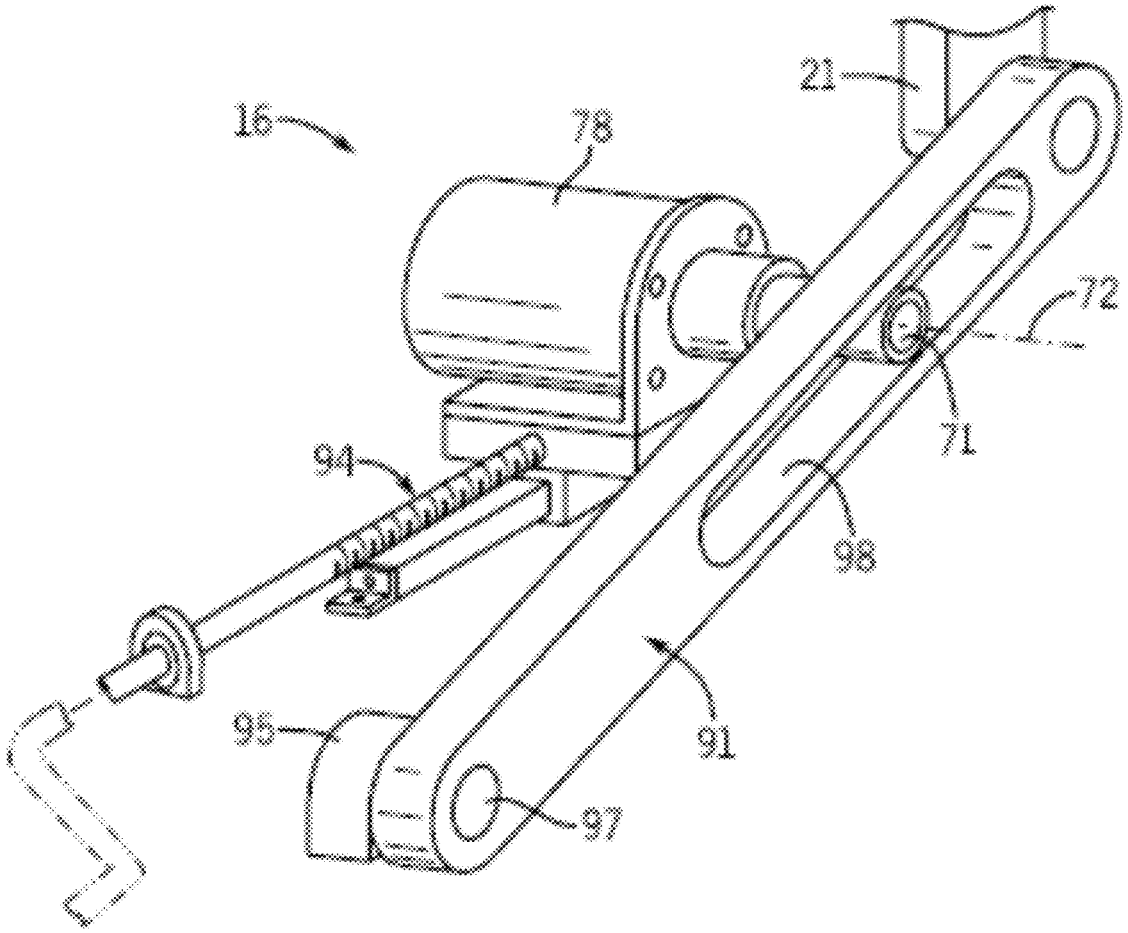
FIG. 12 is a variant of the vibration mechanism of FIG. 10.

FIG. 12 shows a variant of the vibration unit 16 of FIG. 10. In this embodiment, instead of engaging an outer surface of the pivot arm 91, the eccentric wheel 71 is houses within a slot 98 that extends in a longitudinal direction along the pivot arm 91. In this arrangement, the positioner may be defined by the lead screw 94 that can be rotated to move the eccentric wheel 71 along the length of the slot 98. As with other embodiments of the eccentric wheel 71, the eccentric wheel 71 may include a plane bearing that is concentrically mounted to the main body of the eccentric wheel 71 and which provides the interface between the eccentric wheel 71 and the slot 98. In this embodiment, instead of the eccentric wheel 71 being mounted off-set directly upon the motor output shaft (as is shown in FIGS. 10 and 11), an intermediate crank arm interconnects the motor output shaft and the eccentric wheel 71. The rotation of the lead screw 94 may be automated, for example rotated by motor 96 (FIGS. 10 and 11) in communication with the control unit 80 or the lead screw 94 may be manually rotated. For example, a handle or knob may be connected to an end of the lead screw 94 that is further from the motor 78 and which may be provided outside of an enclosure of the vibration unit 16 to permit manipulation by a user.

Although embodiments of the vibration unit 16 have been described as providing a single eccentric 70 that delivers vibration through a single support 20, which may include a pair of platforms 20*a*, 20*b*, which may provide synchronous bilateral limb loading and vibration stimulation. However, it is understood that in some embodiments, the vibration unit 16 includes a separate eccentric 70 for each of the platforms 20*a*, 20*b* of the support 20 and which are independently controlled by the control unit 80 so as to provide asynchronous loading and vibration stimulation. Optionally, alternate loading of a pair of limbs may be achieved by arranging the pivot 97 centrally with respect to the support 20 and arranging the eccentric 70 so as to drive one end of the support to impart a back and forth teetering of the support 20 about the pivot 97.

Figure 13:
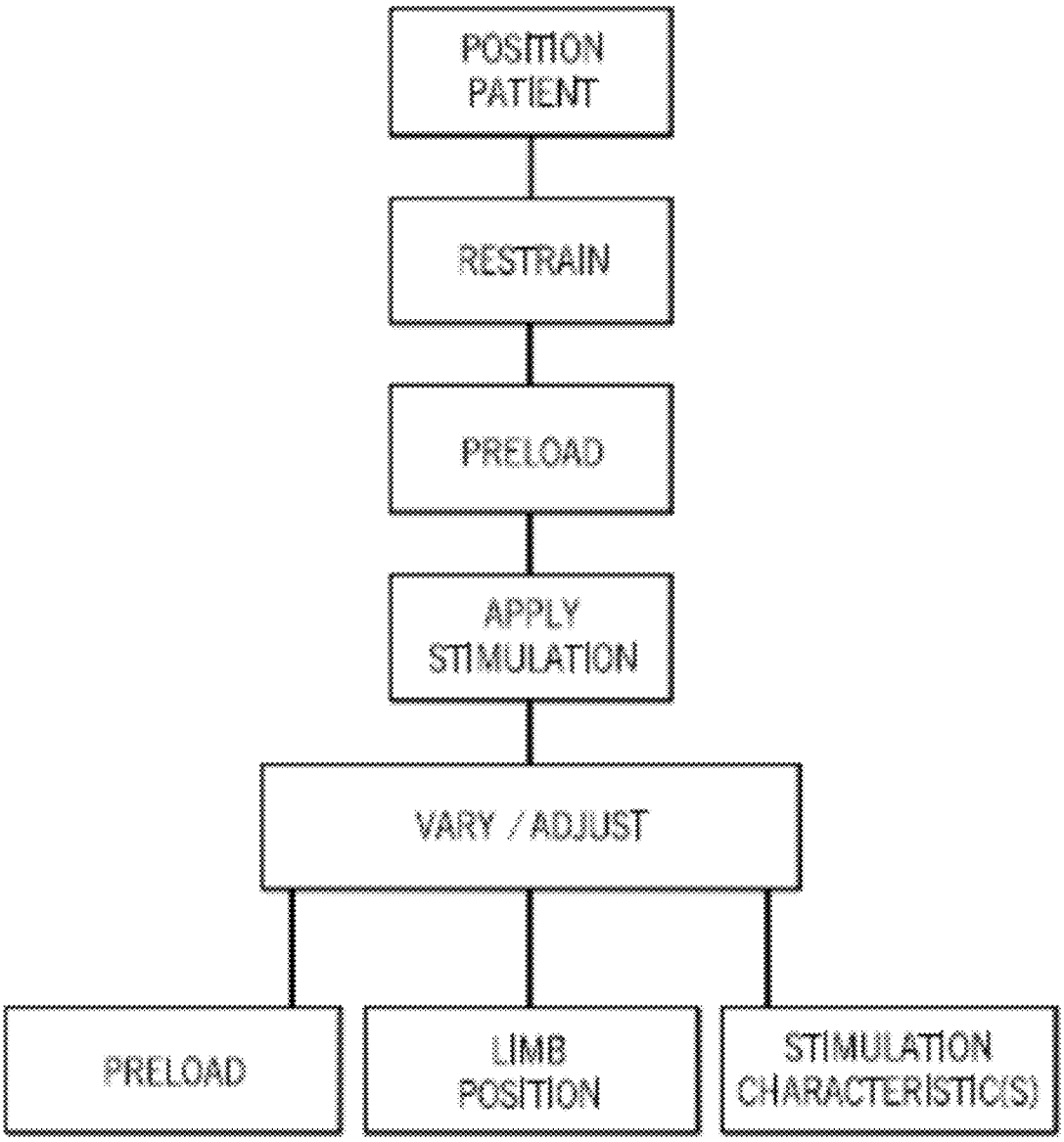
FIG. 13 is a flowchart showing one use of the system.

Referring now to FIG. 13, one suitable technique for using system 10 may include having the patient 11 enter the system and be positioned on the table 14 (FIG. 1) or seat assembly 23 (FIG. 6) and be restrained corresponding to the top two boxes in FIG. 13. During restraint, a joint within a limb that is supported at opposing ends may be restrained against out of axis movement. When upper and lower leg segments are being are supported at the patient's hip and foot, the knee may be restrained in a manner that restricts hip flexion and hip extension of the upper leg so that upward and downward movement of the knee is correspondingly restricted. Compressive loading or a preload is applied in a generally axial or longitudinal direction with respect to the limb and stimulation may be applied to at least one of the end of the limb, corresponding to the third and fourth boxes from the top in FIG. 13. The stimulation may be vibration from the vibration unit 16 that may be transmitted through the lower leg 22, the compressed knee joint, and the upper leg 30 and into the hip.

Corresponding to the bottom two rows of boxes in FIG. 13, the stimulation may be adjusted by varying individual characteristics of the stimulation, independently of the others. By controlling the tension member 36 and/or position drive 37, the compressive preload to the entire limb may be adjusted independently of vibration characteristics. The compressive preload to the limb may be statically held, cyclically reduced and increased, or otherwise varied independently of other system 10 characteristics. By controlling the rotational speed of the output shaft of motor 78, the frequency of vibration may be controlled independently of other system 10 characteristics. By controlling rotation of the motor 96, the amplitude of vibration may be controlled independently of other system 10 characteristics. By controlling the actuator 31, the limb may be moved through a range of motion while maintaining compression of the limb and while the limb receives the stimulation. In this way, each of displacement of the foot support 20, acceleration of the foot support 20, compressive loading of the limb(s), amplitude of vibration, frequency of vibration, and position of the limb segments with respect to each other, may be controlled independently of the others, which may allow the others to be maintained in a constant state or varied at a different rate(s).

It will be appreciated that analogous structure may be used on any jointed limb of the patient 11, for example, the arms. This may be done by anchoring a shoulder of the patient, restraining the patient's elbow against movement along a direction perpendicular to an axis defined between a corresponding hand and the anchored shoulder, preloading the upper arm and lower arm on opposing sides of the elbow, and applying vibration stimulation to the hand so that the vibrations are transmitted through the lower arm, elbow, and upper arm so that the vibration passes into the compressively preloaded shoulder.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom", and "side," describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second", and other such numerical terms referring to structures do not imply a sequence or order unless clearly indicated by the context.

When introducing elements or features of the present disclosure and the exemplary embodiments, the articles "a", "an", "the", and "said" are intended to mean that there are one or more of such elements or features. The terms "comprising", "including", and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

References to "controller" or control unit may include or be coupled to at least one memory medium that may store program instructions for achieving the present functions of the system 10 and can be understood to include one or more controllers or microprocessors that can communicate in a stand-alone and/or a distributed environment(s), and can thus be configured to communicate via wired or wireless communications with other processors, where such one or more processor can be configured to operate on one or more processor-controlled devices that can be similar or different devices. For example, the control unit 80 may include a wireless transmitter(s) and receiver(s) to communicate with remote processors. One such remote processor may be located at a doctor's office where treatments can be monitored and new treatment regimens can be wirelessly transmitted to the receiver of the control unit 80. The control unit 80 may be configured to transmit communications through online web-based or other applications to provide information that may be accessible in real time or later by the user or another designated authorized viewer of such information. Such applications may be usable as part of a diet and exercise tracking software, usable for providing real-time biofeedback to the patient, or usable for a variety of other purposes that may enhance the user experience and may improve patient outcomes. Furthermore, references to memory, unless otherwise specified, can include one or more processor-readable and accessible memory elements and/or components that can be internal to the processor-controlled device, external to the processor-controlled device, and can be accessed via a wired or wireless network.

It is specifically intended that the present invention not be limited to the embodiments and illustrations contained herein and the claims should be understood to include modified forms of those embodiments, including portions of the embodiments and combinations of elements of different embodiments as come within the scope of the following claims. All of the publications described herein, including patents and non-patent publications, are hereby incorporated herein by reference in their entireties.

What we claim is:

1. An apparatus for generating musculoskeletal vibration comprising:

a shaft with a diagonal segment positioned for rotation about an axis angularly intersecting the diagonal segment of the shaft and having an eccentric portion arranged for rotation along an eccentric path about the axis so as to produce vibrations;

a motor for rotating the shaft;

a positioner that engages the eccentric portion at opposite sides of the eccentric portion for adjustably moving the eccentric portion to different locations within the apparatus corresponding to different positions with respect to the diagonal segment of the shaft during use; and a support that can engage a foot of a user of the apparatus and that is adapted to be reciprocally driven by the eccentric portion to receive vibrations having an amplitude that corresponds to a position of the positioner and the eccentric portion with respect to the diagonal segment of the shaft within the apparatus and so as to adjustably conduct the vibrations to the foot during use.

2. The apparatus of claim 1, wherein the eccentric portion includes a bearing that can move in a radial direction relative to the axis for varying the vibration amplitude.

3. The apparatus of claim 2, wherein the bearing can move along the diagonal segment of the shaft so as to move the bearing closer to or further from the axis for varying the vibration amplitude.

4. The apparatus of claim 3, wherein the positioner includes a fork that engages opposing end surfaces of the bearing.

5. The apparatus of claim 4, wherein the positioner includes a linear actuator that engages and can move the fork.

6. The apparatus of claim 5, wherein the linear-actuator includes a lead screw.

7. The apparatus of claim 3, wherein the shaft includes first and second ends that are radially spaced from the axis.

8. The apparatus of claim 7, wherein the first end of the shaft is radially spaced further from the axis than the second end is radially spaced from the axis.

* * * * *